US006290630B1

(12) United States Patent
Boland

(10) Patent No.: US 6,290,630 B1
(45) Date of Patent: Sep. 18, 2001

(54) UPPER BODY EXERCISE MACHINE

(76) Inventor: Kevin O'Brien Boland, 5623 Massachusetts Ave., Bethesda, MD (US) 20816

( * ) Notice: Subject to any disclaimer, the term of this patent is extended or adjusted under 35 U.S.C. 154(b) by 0 days.

(21) Appl. No.: 09/516,761

(22) Filed: Mar. 1, 2000

Related U.S. Application Data

(60) Provisional application No. 60/130,953, filed on Apr. 26, 1999.

(51) Int. Cl.[7] ..... A63B 21/04

(52) U.S. Cl. ..... 482/130; 121/112; 121/123

(58) Field of Search ..... 482/112, 123, 482/130, 142, 121, 908, 138, 139, 140

(56) References Cited

U.S. PATENT DOCUMENTS 4,241,913 * 12/1980 Zwayer et al. ..... 482/112
4,618,144 * 10/1986 Gibson ..... 482/130
5,277,684 * 1/1994 Harris ..... 482/130
5,352,171 * 10/1994 Lin ..... 482/95
5,810,702 * 9/1998 Wilkinson ..... 482/142

* cited by examiner

*Primary Examiner*—Jerome Donnelly
(74) *Attorney, Agent, or Firm*—A. R. Eglington

(57) ABSTRACT

A free-standing physical exercise device which can be configured for either kneeling or standing use, including a ground supported frame, a vertical mast secured hingedly thereto for storage, a slidable position support mechanism mounted on the mast, and a set of hand grippable levers, which can be preset to one of three extension angles for the lever, a lever support bracket permitting the arcuate movement of the lever bars about the support mechanism, and means to interruptibly lock the slidable position support mechanism on the mast in any one of a plurality of operating modes. A dual direction, resistance means is operatively connected between the lever support bracket and the mast-mounted, slidable mechanism which then provides a variable resistance to the arcuate motion of the levers in both directions.

11 Claims, 5 Drawing Sheets

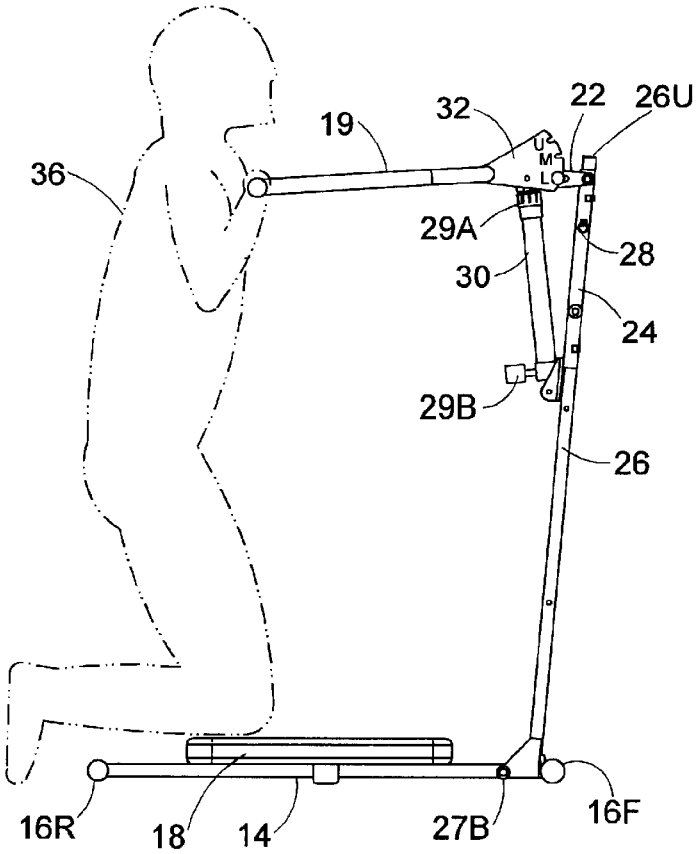
FIG. 2
FIG. 3
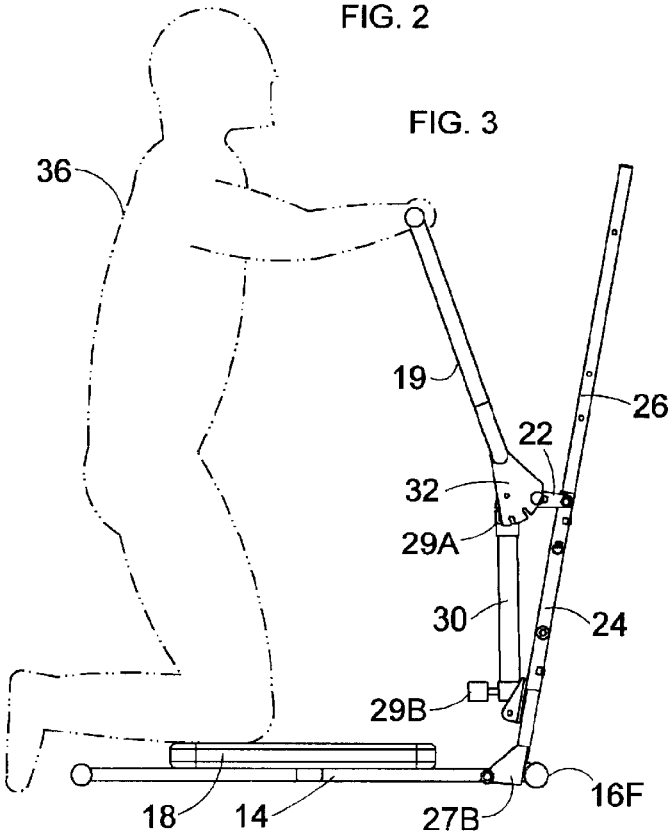

UPPER BODY EXERCISE MACHINE

CROSS-REFERENCE TO OTHER APPLICATIONS

This is a regular patent application, titled: UPPER BODY EXERCISE MACHINE being submitted for an official filing receipt under 35 U.S. Code §111(a). It also relates to Mar. 1, 1999, with the same title, and provisional patent application for 60/130,953, filed Apr. 26, 1999.

FIELD OF THE INVENTION

The present invention relates to a readily movable, storageable and use convertible device adapted for selective human upper torso conditioning and development.

BACKGROUND OF THE INVENTION

The need for practical and affordable devices suitable for muscle toning and body conditioning is a long established one. There are a large variety of exercise devices, many of which focus on conditioning just one set of muscles, but only a few which are adapted to toning of two related sets of muscles; for example, biceps and triceps, or lats and pectorals. Among the needs are an exercise machine which, in overall concept, can make use of plural positions on a grippable mast component for effecting several corresponding articulations. There remains a need for a machine that is relatively compact, very versatile, and easily storable.

Fitzpatrick 5,037,090 (1991) is to a free-standing exercise device having two support components, serving either as a posture sitting stool 8 or a kneeling stool 7. It uses a vertical mast 2 and a handle-bar type of pivoted lever 10, with the latter working against an obverse mast-side resistance means 13. Each of the two positions for seat 7 provide for certain exercises, all of which require a user to either stand or kneel on the seats 7/8. The range of exercises available with the device are very limited, affording only three basic exercises: shoulder press, lat pull down, and tricep extension. The present invention has two features: variable lever settings and sliding sleeve, which makes this device at least twice as versatile as Fitzpatrick's . The largest difference between the present invention and Fitzpatrick's is that the present invention use of cam affords both vertical and horizontal exercise motions. Fitzpatrick's invention, is only capable of vertical motions. Earlier mechanism does not provide the broad array of exercises that are doable with the present invention, specifically: the lat pull down, the chest press, the biceps curl, the shoulder press and upright row, a shoulder shrug, and the triceps extension (all depicted in composite FIG. 5). Nor is it possible with the previous device to do the biceps curl of present FIG. 4, which is afforded by the present device. Thus, the range of available exercises with the present device substantially exceed those of the exercise device of Fitzpatrick '090.

SUMMARY OF THE INVENTION

The present invention works completed muscles of upper body, which is very rare for such a versatile, compact, easily transportable, and storageable, exercise machine. Thus, it is a principal object of the invention to provide a single portable device which has alternate modes of operation, each mode being for muscle loading use of the upper limbs, including various arm extension exercises.

Another object of the invention is to provide a hand grippable, lever subassembly and support bracket, and a variable position means, which is mounted on a mast component, which can be slidably translated into an alternate modes of operation for effecting different exercises.

Another object of this invention is to provide a unique cam lever, which allows the hand grippable bar to move in two distinct motion planar paths; vertical and horizontal, respectively, affording greater versatility and a complete upper body workout.

It is still another object of the invention to provide a machine, which is both portable and readily storable, and which focuses on the muscle sets of the upper body.

It is still another object of this invention to provide a dual effect, resisting hydraulic cylinder, providing resistance in both upward and downward directions during shoulder press exercises to exercise the latissimus-dorsi muscles.

A still further object is to provide a leg squat exercise when the variable position means is at the lowermost position on the mast.

It is still another object of the invention to provide a portable machine, which includes an adjustable-position, channel-containing subassembly that permits at least eight exercises from a single supporting mast which is anchored to its supporting floor chassis.

It is still another object of the invention to provide an uncluttered configuration of components having great versatility.

BRIEF DESCRIPTION OF FIGURES

FIG. 2 is a side elevational view of the device of the present invention, oriented to operate in the first mode, wherein the user confronts and grasps overhand an outwardly extending, hand grippable bar assembly, while kneeling for maintaining body support;

FIG. 3 is a another side elevational view of the device of FIG. 1, now oriented in a second mode of operation (action mechanism much lowered), while still kneeling, wherein the user grasps overhand the upwardly extending hand grippable, handle bar assembly for providing an alternate set of exercises;

DETAILED DESCRIPTION OF A PREFERRED EMBODIMENT

Figures 1, 10:
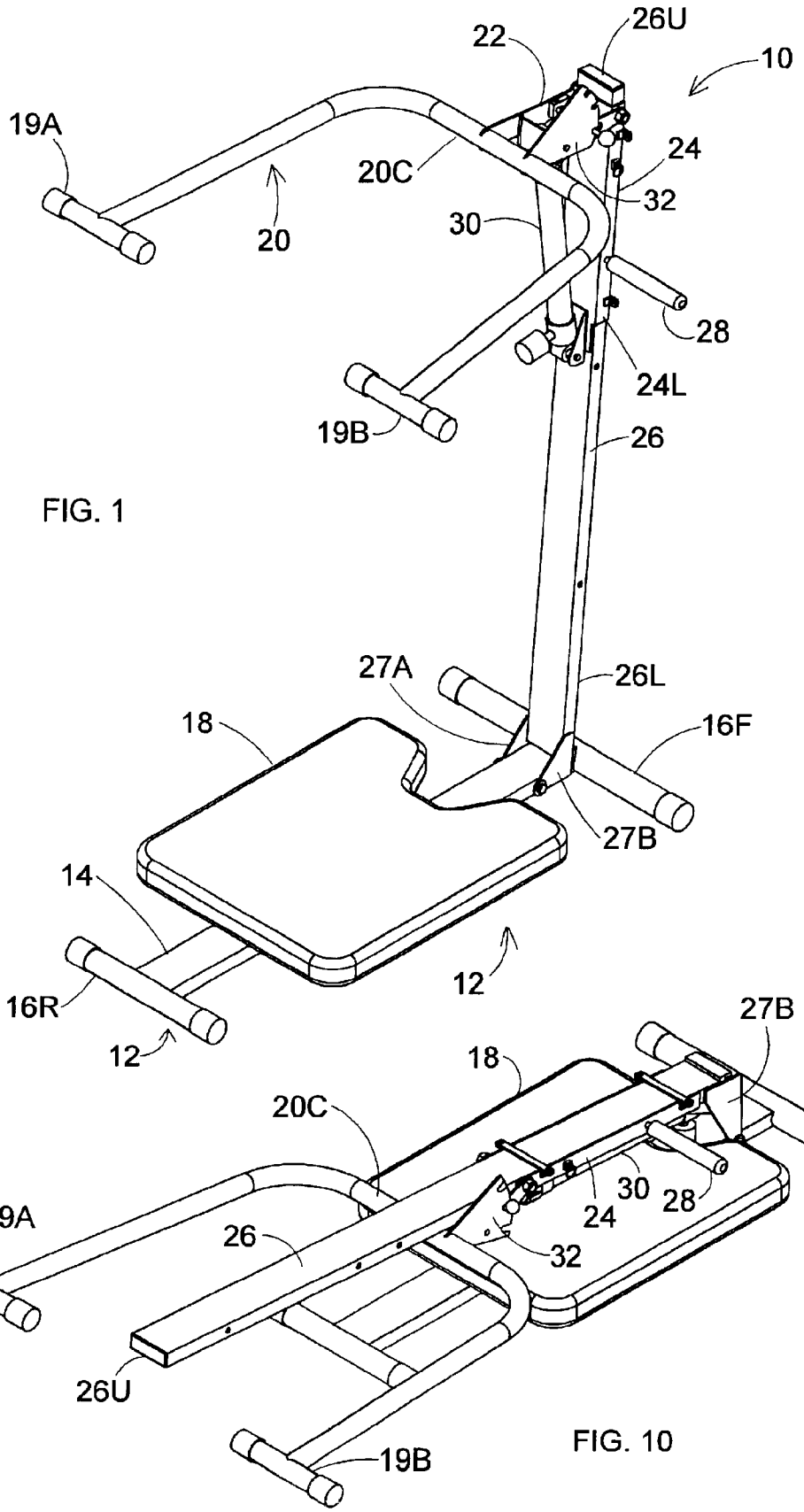
FIG. 1 is a perspective view of the assembled device having a slidable action mechanism shown in a first upper operating mode for conducting certain of the exercises to be described.
FIG. 10 is a perspective view of the assembled device in a second embodiment adopted for conduct of a leg pres exercise while the user is prone upon a support cushion.

Referring now to the drawing, and to FIG. 1 in particular, the inventive exercise device 10 is depicted in a first of several modes of usage. Floor frame 12 has an elongate rigid member 14, having a first forward (hinged) cross member 1 6F, and a second rearward cross member 16R for stability during usage. A user (FIG. 2), while kneeling on a cushion pad 18, mounted on chassis member 14, confronts and grips firmly the rearwardly projecting, handle bars, 19A/B of lever component 20. Lever 20 is anchored at its central segment 20C to a dual sidewall, mounting bracket 22, which bracket is mounted pivotally at its inner end to an elongate, slidable action mechanism 24. Mechanism 24 is a U-shaped, open channel member adapted to complement and overlap the outer surface of an elongate vertically oriented, tubular mast 26. Mast 26 is pivotally connected at its lower longitudinal end 26L to floor member 12, at a point located intermediate of cross member 16F and cushion 18. End flanges 27A/B on mast end 26L effect that hinged connection.

A horizontal handle 28 is operatively connected intermediate the ends of mechanism 26, serving to move between one or more of the plural positions for the mechanism 24 along vertical mast 26 for a certain exercise group. One grasps handle 28 so as to move mechanism 26 reciprocally to one of the selected levels.

Disposed substantially vertically in the plane of mast 26 and of upper end bracket 22 is a standard resistance means 30, typically a hydraulic piston and cylinder. Resistance means 30 is operatively connected at its movable piston, longitudinal end to bracket 22, and is connected at its other longitudinal end (cylinder component) to the lower end 24L of action mechanism 24. The supporting interconnections are made pivotal at both ends of the resistance means 30.

A single, fan-shaped plate 32 is also anchored on one sidewall with its apex pinned to the mid-segment 20C of lever means 20, and oriented operatively (to be described) along its arcuate edge to adjoining projecting bracket 22, being sidewall-mounted thereon, in a pivotal manner.

Hydraulic damper 30, pivotally linked between support elements 20 and 26, is configured to provide for adjustable resistance in both directions, as the gripping bars are being forced in either direction by the user. Knurled knob 29B at the lower end serves to effect adjustable resistance level on the return stroke.-A cap-like knob 29A is located at the upper end of damper 30, and provides 12 different settings which vary the resistance level on the initial half of the lever cycle for the forward motion.

The in-use configuration depicted in FIG. 2 corresponds to that mechanism mode 24 of FIG. 1. A kneeling user 36 confronts and grasps the overhandedly, the transverse elements 19L/R of lever 20. The resulting arcuate movement is effected while in the highest operable position for slidable mechanism 24, and such is the one position for either of the shoulder press or the lat exercises.

In the alternate operational mode of FIG. 3, the user still kneels, but the slidable action mechanism 24 has been shifted downwardly to be proximal to the lower longitudinal end 26L of bottom hinged mast component 26. The horizontal motion exercise provides the chest press. The mast lower end is pivotally anchored via flange 27B to floor chassis 14. In this mode, the grippable bars 20 are extended vertically upward. Knurled knob 29 functionally linked to the cylinder end of means 30 serves to adjust the apparent resistance, on the return motion of the lever means.

Figure 4:
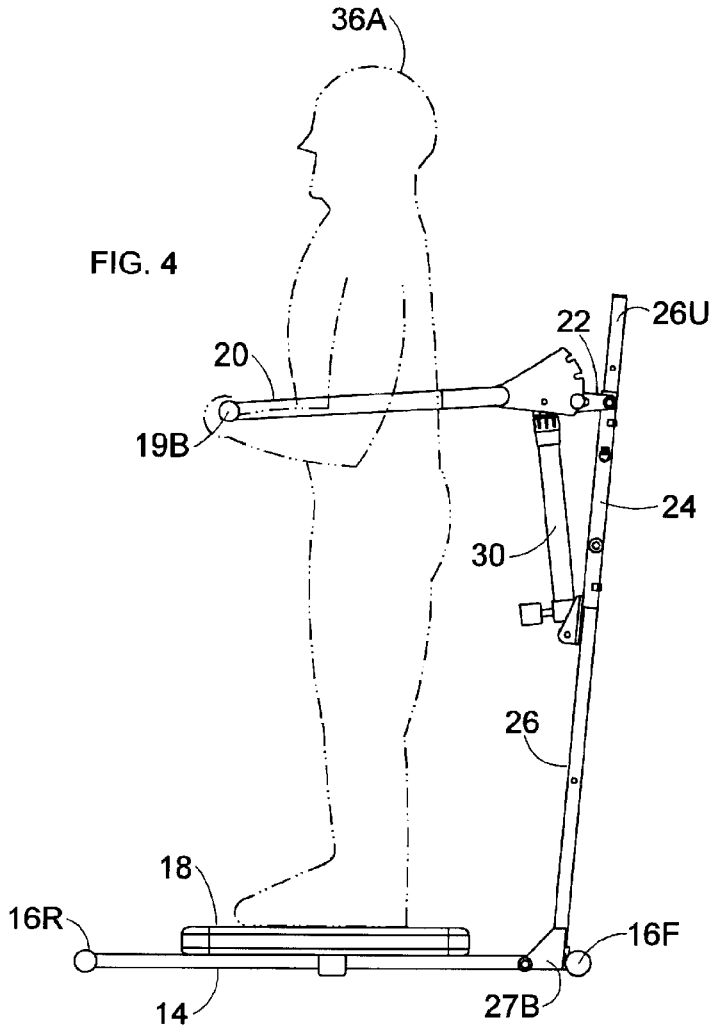
FIG. 4 is a schematic side elevational view of the device of FIG. 1 with a standing user in a rearwardly-facing, erect mode of exercise levels.

In the schematic view of FIG. 4, a standing user 36A is facing rearwardly, and is positioned between the lever bars 20, while grasping the end grips 19A/B in an underhand manner. The slidable action mechanism 24 itself remains locked in a second vertical level (from the top) position, as is depicted, which is somewhat below the topmost position depicted in FIG. 1. In the now depicted user erect posture, the curl (palms up) and the triceps extension (palms down) exercises are conducted.

The composite schematics of FIG. 5 depicts just six discrete exercises available with of the present device. These are: FIG. 5A, the lat pull down; FIG. 5B, the chest press; FIG. 5C, the biceps curl; FIG. 5D, the shoulder press; FIG. 5E, the shoulder shrug and upright row; and in FIG. 5F, the triceps extension. Not seen in the composite views of FIG. 5, is the option of a leg squat exercise doable with action mechanism 24 locked at its lowest level on the mast 26.

Figure 6:
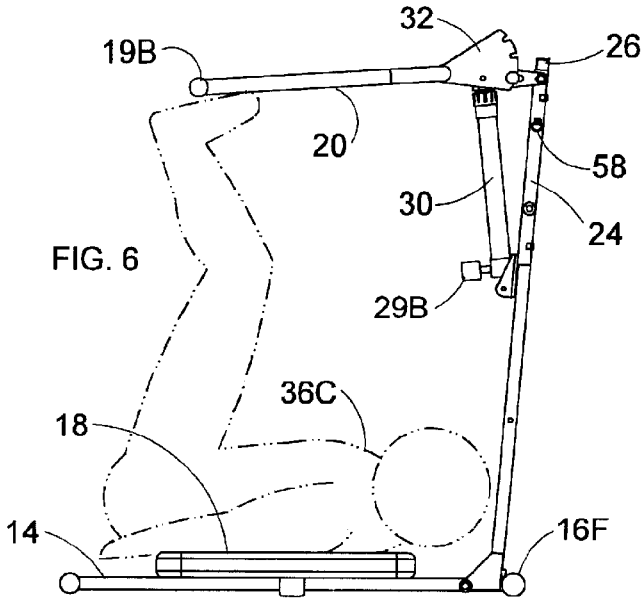
FIG. 6 is a schematic elevational view depicting the device with action mechanism shown in the operating mode, but with user prone to effect a leg press exercise.

A third position (user back is prone) is depicted in FIG. 6, wherein sliding mechanism 26 is at the uppermost level on mast 24 (as in FIG. 1) and user 36C has extended legs engaging the transverse elements 19L/R in an arcuate range of motion.

Figure 7:
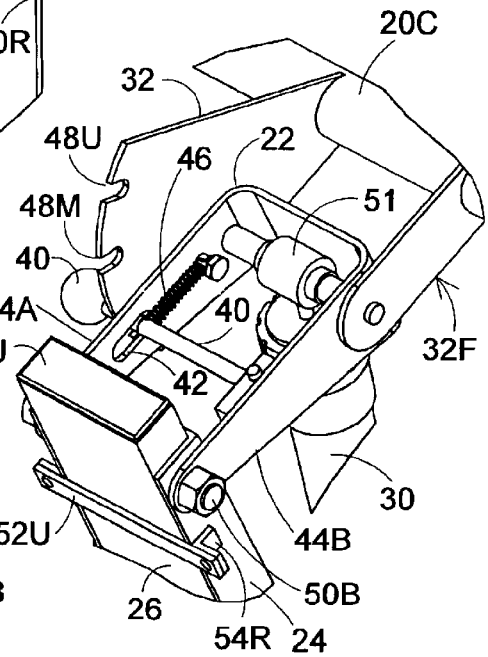
FIG. 7 is a broken away, differing angle enlarged perspective view of the same action mechanism, linking bracket and interlocking means, all used for activating the exercise device in the disclosed exercises.

In FIG. 7 is a broken away, perspective view of the manner of pivotally connecting the lever mid-segment 20C, the pivoted bracket 22, the interlocking transverse rod 40, the angle-setting fan plate 32, all into an operative interlinking mode, with slidable action mechanism 24. Knobbed rod 40 rides in an horizontal slots 42 provided in one bracket sidewalls 44A. Spanning rod 40 is bias loaded, via spring 46, to be pivotally seated into, and to be retained in, one of the peripherally located, spaced apart set of notches, 48U, 48M, and 48L, each notch serving as distinct for angle detents lever. The specific notch, which is engaged, then determines the outward angle of extension of the lever component 20 away from the mounting bracket 22. Once a notch on fan plate 32 is engaged by rod 40, then the lever component 20 and linked pivoted bracket 22 itself, swing arcuately about the inner longitudinal ends 50 of the bracket sidewalls 44A/B, which ends are bolted, 50A/B, proximal to the upper longitudinal end sidewalls of sliding mechanism 24.

Figure 8:
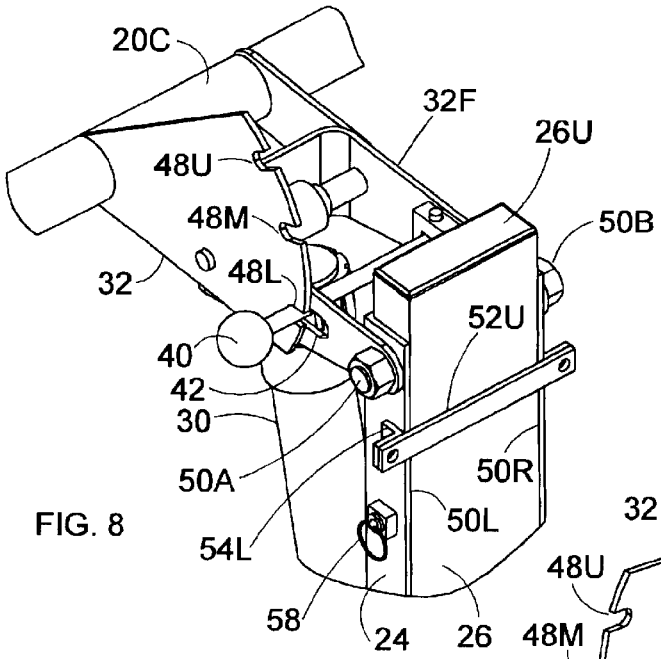
FIG. 8 is a broken away, enlarged perspective view of the pivoting components of the slidable mechanism and interlock means for the lever component, depicting the lowermost intermediate position of the three permitted for fixing extension of the bar bracket component.

The perspective view of FIG. 8 depicts the very same linkage from an opposite angle. Whichever of notches 48 A,B, or C are interlocked with knobbed spanning rod 40, as noted, then such determines the angle of outward extension of the lever component 20. Such varied extension angles are depicted in the schematics of FIGS. 2, 3, and 4. Fan shaped flange 21 (adjacent bracket sidewall 49A) has an opposing sidewall, 32F, which paired flanges links lever means 20C to the operative elements of support bracket 22.

Note that in both FIGS. 7 and 8, that the open channel, slidable mechanism 24 is spanned, as well on its obverse side along linear edges 50L/R, by a fastener bar 52U. Bar 52U has an inwardly oriented, spaced-apart flange elements 54L/R, proximal to each longitudinal end thereof. A similar bar (not seen) is provided proximal to the lower end of channeled member 24. These two fastening bars 52U/L serve to retain action mechanism 24 overlapping of the mast 26, while it is being moved reciprocally along the mast itself, to one of its several operating modes, to be described. Ring set, slidable pin 58, located proximal to upper end of the action mechanism, serves as a vertical position, adjustment pin for the interlocking of slidable mechanism on the mast.

Figure 9:
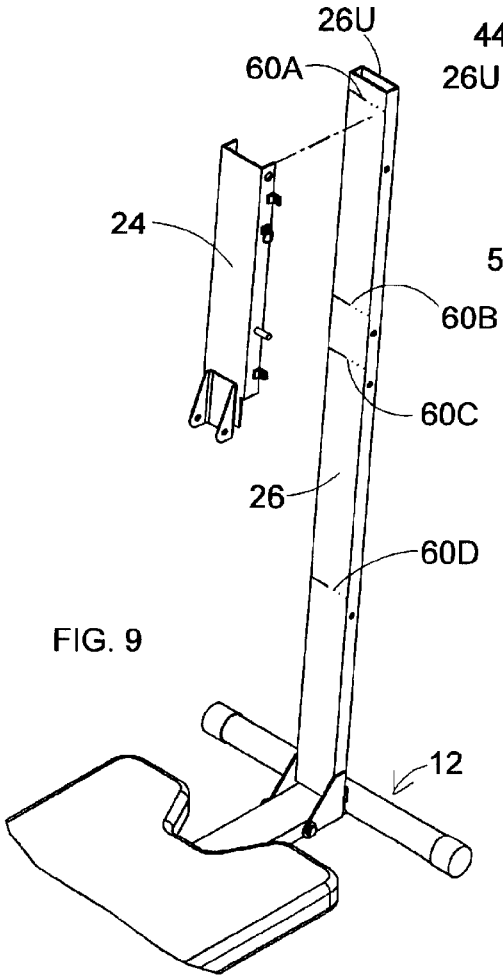
FIG. 9 is a schematic of the isolated vertical mast component depicting four discrete levels for transient locking in of the slidable action component of FIG. 1, 7 and 8, with the upper edge thereof correlated to certain specific exercises of the several that are doable with the present device; and, FIG. 10 is a perspective view of the present exercise device in a configuration storable as in a closet or under a bed.

In the perspective view of FIG. 9, the isolated mast 26 is shown now with an indication of four spaced-apart, horizontal markers, on its wider surface, suited for aligning the top end of the slidable mechanism 24 relative to its supporting mast 26. These top end offsets are measured from the free upper end 26U of mast 26. Mechanism position 60A corresponds to that used for the lat pull down and the shoulder press exercises of FIG. 5D; mechanism position 60B corresponds to that used for the curls and triceps of FIGS. 5C/5F; mechanism position 60C corresponds to that used for the shoulder shrugs and upright rows of FIG. 5E; and vertical position 60D corresponds to that used for the chest press of FIG. 5B. The vertical distances from the upper mast 26U end to the indicated mechanical positions 60A/B/C/D, are 1", 7", and 10.5", and 26", respectively. The overall length of the U-channel, slidable mechanism 26 itself is 15.75". The option of more levels remains.

At level 60A, the fan-shaped plate is in the lower notch, 32L, and affords both a shoulder press exercise, on the up motion and a lat pull down exercise, on the down motion. At level 60B, the fan-shaped plate is also in the lower notch position and affords a curl and tricep extension. At level 60C, the fan-shaped plate is still in the lower notch position and affords two additional exercises—shoulder shrug and upright rows for the shoulders. At level 60D, the fan-shaped plate 32 is in the upper notch position, 32U, and affords the chest press in a horizontal path. To store the machine, the fan-shaped plate is in the middle notch position, 32M, as shown in FIG. 10.

The fan-shaped plate 32 is the preferred embodiment for adjusting the hand grippable bar 19 from a horizontal position to a vertical position. One could also rotate the hand grip bar 180 degrees with a rotating mechanism, as shown in inventor's provisional patent submission supra. It would work like an auto steering wheel to achieve two different grippable bar positions. This alternative embodiment would include a knob which, when loosened, would afford the user rotating the hand grippable bar from the vertical to the horizontal position.

In Operation

This machine offers a wide variety of exercises via some unique machine components. These two components are the fan-shaped plate and the sliding mast sleeve. The fan-shaped plate allows the grippable bar to rotate from a horizontal position to a vertical position. By rotating from these two positions, two entirely different exercise plane paths are afforded. When the grippable bar is basically horizontal, the machine affords these exercises—shoulder press, lat pull down (short for latisimus dorsi), biceps curls, tricep extension, shoulder shrug and upright row. When the grippable bar is vertical, the machine affords a chest press exercise.

The sleeve can be locked in four different positions on the mast and possibly more. To move the sleeve, the user pulss a spring loaded pin 58 which allows the sleeve to slide. Then, while holding the horizontal handle 28, the user slides the sleeve into the desired position. These four positions are upper, upper middle, lower middle and lower. In the upper mast position, the user can do a shoulder press or a lat pull down. In the upper middle position, the user can do a curls and triceps extension. In the lower middle position, the user can do a shoulder shrug and upright row. In the lower position, the user can do a chest press.

Some of the exercises need almost no adjustments of the machine or user's grip to afford two entirely different exercises. For example, when the user is doing a shoulder press on the up motion and on a lat, pull down on the down motion automatically. The dual resistance cylinder affords this very efficient exercise system which affords toning for both the shoulders and lats in one exercise.

Figure 5A:
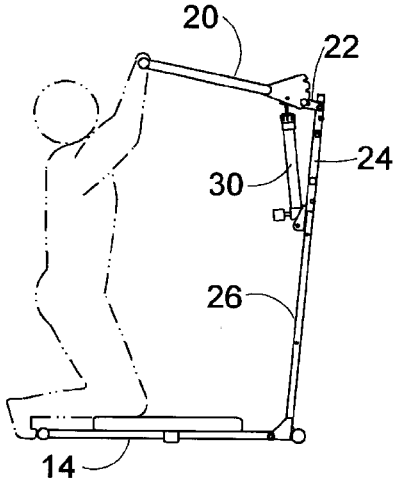
FIG. 5 is a composite schematic view of six other exercises, with the slidable action mechanism being locked at one of several alternate levels provided on a mast.
Figure 5B:
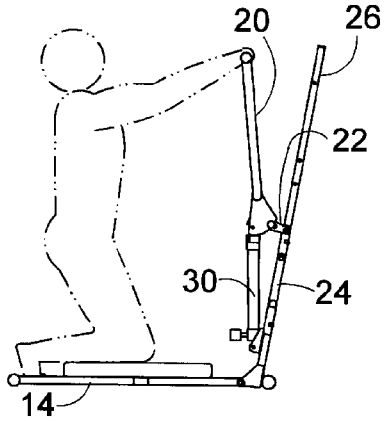
Figure 5C:
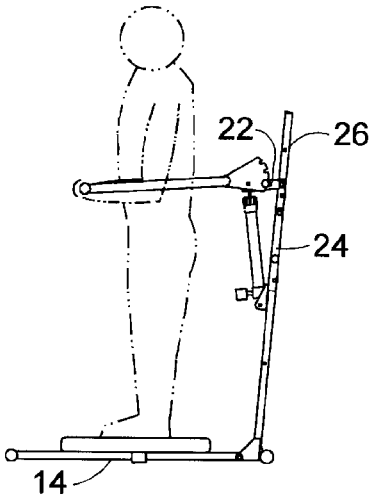
Figure 5D:
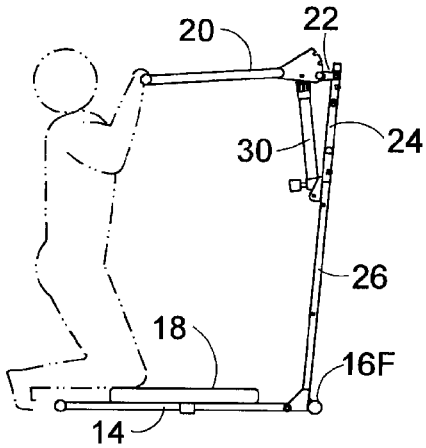
Figure 5E:
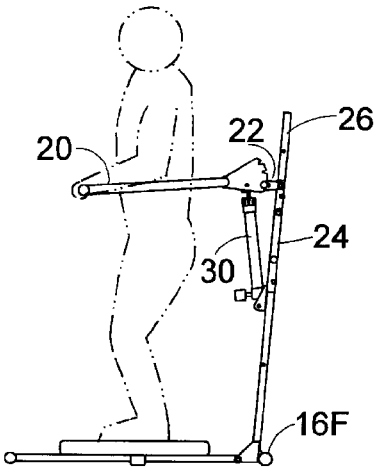
Figure 5F:
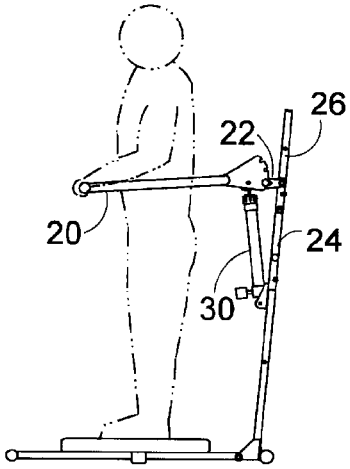

As with the shoulder press and lat pull down, the biceps curl and tricep extension require no machine changes, and only the user rotating their palms up for biceps curls and down for tricep extension. The curling exercise actually works best when the user turns with his back facing the machine. With the user's back to the machine, the more proper curling motion is the result. The most optimum position for biceps curls and other exercises like the shoulder shrug finds the user's back facing the mast because the most beneficial range of motion is afforded from this position. Most of the exercises are displayed in FIGS. 5A–5F, including 5A, the lat pull down; FIG. 5B, the chest press; FIG. 5C, the biceps curl; FIG. 5D, the shoulder press; FIG. 5E, the shoulder shrug and upright for the shoulders and in FIG. 5F, the triceps extension.

The configuration of the disclosed device as seen in FIG. 3 is also adapted for doing the leg squat exercise, notably with channel member 24L in the lowermost mast position (at 60D in FIG. 9). However, the grippable bar member 19 would be disposed in a horizontal orientation as seen in FIG. 2. At the start of a leg squat exercise, the position of user 36 would be facing backwardly, as is depicted in FIG. 5E.

What is claimed is:

1. A free-standing physical exercise device which can be configured for use in either a knee support mode or in an upstanding mode, both based on a single ground supported frame comprising:

(a) a forward first and a rearward second cross member located at the respective longitudinal ends of an elongate rigid member, adapted for conferring stability during operation;

(b) a knee support element located intermediate of the longitudinal ends of the elongate rigid member;

(c) a substantially rigid, upstanding mast pivotally anchored at its lower longitudinal end to the rigid member at a point intermediate of the knee support element and the forward first cross member;

(d) a slidable action mechanism adapted to track and complement the rigid mast, being reciprocally moveable in a slidable manner, so as to engage the mast which then serves as a support means in a plurality of vertical operating positions;

(i) means to interruptibly interlock the upstanding mast and action mechanism in any one of the plurality of vertical positions;

(e) a dual sidewall, support bracket pivotally anchored proximal to the upper end of the slidable channel action mechanism and extending substantially horizontally therefrom, the bracket provided with one slot-like aperture intermediate the free ends of one of the spaced apart sidewalls;

(f) a rigid rod disposed transversely of the dual sidewalls and being movable reciprocally within the one aperture;

(g) an elongate lever component projecting rearwardly and interconnecting operatively with support bracket;

(h) a plate rigidly engaging the central segment of the lever component proximal to a first rearward edge of the plate;

(i) a set of at least three spaced apart, detents provided in the periphery of the opposing forward edge of the plate, which are adapted to receive interruptibly the shaft of the rigid rod;

(j) a elongate component projecting rearwardly of the upstanding mast and interconnecting operatively with the support bracket thereof; and, (k) a resistance means aligned in the plane of the rigid member and the associated upstanding mast, being operatively connected at one longitudinal end thereof to the support bracket and with the other longitudinal end of the resistance means being pivotally connected proximal to the lower longitudinal end of the action mechanism;

(l) whereby the triple engagement positions as provided by the set of peripheral detents correspond to three distinct juxtapositions for the lever component, and which lever juxtapositions correlate with the several vertical alignments available for the slidable action mechanism.

2. The exercise device according to claim 1, wherein the lever component comprises a pair of handles provided on the free end of the lever component and being movable in a generally vertically oriented arc.

3. The exercise device according to claim 1, wherein the resistance means is adjustably attached to the support bracket so that the apparent resistance can be modified.

4. The exercise device according to claim 1, wherein the resistance means comprises a hydraulic piston and cylinder component.

5. The exercise device according to claim 1 wherein the resistence means is adapted for producing resistance in both directions of the lever component motion.

6. The exercise device according to claim 1 wherein the set of detents comprise notches located in the arcuate periphery of the plate and which notches are adapted to receive and to hold interruptibly the shaft of the shiftable rigid rod.

7. The exercise device according to claim 1 wherein the slidable action mechanism comprises an U-shaped, rigid open channel member sized to complement and overlap the upstanding mast, and having one or more edge spanning elements that retain the mechanism along the outer surface of the mast.

8. The exercise device according to claim 1 wherein the plate is fan-shaped and the detents are provided in the arcuate periphery thereof.

9. The exercise device according to claim 1 wherein the transversely disposed rigid rod is provided with a means to retain the rod shaft locked in one of the selected detents during device use.

10. The exercise device according to claim 1 wherein the lever component is oriented so that the detent-bearing plate engages the rigid rod at the lowermost detent, whereby the device affords alternatively the conduct of one of the shoulder press exercise and a lat pull down exercise and a leg press exercise.

11. The device according to claim 1 wherein the lever component is oriented so that the detent-bearing plate engages the rigid rod at the uppermost detent, whereby the device affords conduct of the chest press exercise.

* * * * *